US005941170A

United States Patent [19]

Davis et al.

[11] Patent Number: 5,941,170

[45] Date of Patent: Aug. 24, 1999

[54] PRECONDITIONING RECEIVERS USING CERAMIC HEATING ROLLERS

[75] Inventors: Stephen V. Davis, Rochester; Jiann H. Chen, Fairport; Dilip K. Chatterjee, Rochester, all of N.Y.

[73] Assignee: Eastman Kodak Company, Rochester, N.Y.

[21] Appl. No.: 09/054,746

[22] Filed: Apr. 3, 1998

[51] Int. Cl.[6] ..... B30B 3/04; B30B 15/34; F26B 13/04

[52] U.S. Cl. ..... 100/328; 34/113; 100/155 R; 100/330; 100/334; 492/53; 492/54

[58] Field of Search ..... 100/155 R, 327, 100/328, 330, 332, 334; 34/110, 113; 492/53, 54, 58, 59

[56] References Cited

U.S. PATENT DOCUMENTS

| | | | |
|---|---|---|---|
| 3,057,075 | 10/1962 | Lippke | 100/334 |
| 4,704,776 | 11/1987 | Watanabe et al. | 492/54 |
| 4,848,225 | 7/1989 | Arai et al. | 100/155 R |
| 5,101,574 | 4/1992 | Orloff et al. | 34/18 |
| 5,223,099 | 6/1993 | Salo | 100/332 |
| 5,257,966 | 11/1993 | Watanabe et al. | 100/155 R |
| 5,290,332 | 3/1994 | Chatterjee et al. . | |
| 5,334,288 | 8/1994 | Nasu et al. | 492/54 |
| 5,336,282 | 8/1994 | Ghosh et al. . | |
| 5,358,913 | 10/1994 | Chatterjee et al. . | |
| 5,403,656 | 4/1995 | Takeuchi et al. | 492/59 |
| 5,543,269 | 8/1996 | Chatterjee et al. . | |
| 5,600,414 | 2/1997 | Hyllberg | 492/53 |
| 5,609,098 | 3/1997 | Abe et al. | 100/334 |

*Primary Examiner*—Stephen F. Gerrity
*Attorney, Agent, or Firm*—Raymond L. Owens

[57] ABSTRACT

Apparatus for drying receiver sheets prior to such receiver sheets receiving electrophotographic images, including at least one set of preconditioning rotatable rollers with each preconditioning rotatable roller in the set touching an opposing preconditioning rotatable roller to form a nip, wherein at least one of the preconditioning rotatable rollers in the set is formed from zirconia ceramic or zirconia composite; and the apparatus heating at least one of the surfaces of the preconditioning rollers of the set to dry receiver sheets as each passes through the nip.

10 Claims, 1 Drawing Sheet

PRECONDITIONING RECEIVERS USING CERAMIC HEATING ROLLERS

CROSS REFERENCE TO RELATED APPLICATION

Reference is made to commonly-assigned and concurrently filed U.S. patent application Ser. No. 08/822,163 filed Mar. 21, 1997, entitled "Zirconia Ceramic Roller For Fixing Particulate Imaging Material to a Receiver" by Chatterjee et al and U.S. patent application Ser. No. 08/821,991, filed Mar. 21, 1997, entitled "Toner Offset Preventing Oils for Zirconia Ceramic and Its Composites Rollers" by Chatterjee et al, the teachings of which are incorporated herein by reference.

FIELD OF THE INVENTION

The present invention relates to preconditioning rotatable rollers which remove moisture from a receiver sheet.

BACKGROUND OF THE INVENTION

Electrophotosensitive copiers include a photoconductor with a photoconductive layer with a conductive backing. The photoconductor is transported along an endless path relative to a plurality of work stations, each of which is operative when actuated to perform a work operation on the electrophotosensitive medium. Such stations include a charging station at which a uniform charge is placed on the photoconductive layer, an exposure station at which the charged photoconductive layer is image-wise exposed to actinic radiation from the medium to create an electrostatic image of the medium in the photoconductive layer, a developing station at which the electrostatic image is contacted with finely divided charged toner particles for adhering to the photoconductive layer in a configuration defined by the electrostatic image, a transfer station at which such toner particles are transferred in the image configuration to a receiving surface, and a cleaning station at which residual toner is removed from the photoconductive layer so that it can be reused. The electrostatically held toner image is then adhered to the receiver sheets by flowing the toner particles together.

In seeking high quality images, there are a number of problems which are all related to moisture content of the receiver varying either from sheet to sheet of from side to side in a duplex process. Problems relating to the receiver moisture content from sheet to sheet are toner laydown consistency as receiver charging ability varies with moisture content. Receiver sheet blistering may also occur should some receiver sheets exceed a certain moisture level (critical level is dependent on receiver sheets weight, thickness, clay content, coating, fusing temperature and process speed) from moisture leaving the receiver sheets too quickly. Fusing the toner to the receiver through transportation through a heated nip will dry receiver sheets as well causing it to shrink and then grow again as it regains moisture causing one of the largest problems, front to back registration errors, which are cause by the receiver sheets being smaller when the duplex image is placed on the receiver. To reduce all of these problems the receiver must be preconditioned to reduce the difference in charging ability of the receiver that enters for toner transfer, to gently reduce the moisture content to reduce blistering and to shrink the receiver for the simplex pass to reduce shrinkage through the duplex path. Receiver sheets are preconditioned by passing the receiver sheets through heated preconditioning rotatable rollers which are easy to clean (to remove paper dust), thermally conductive, and exhibiting toner release properties similar to but not as stringent as fuser roller as toned images would rarely come in contact with these preconditioning rotatable rollers.

SUMMARY OF THE INVENTION

It is an object of the present invention to provide preconditioning rotatable rollers which precondition receiver sheets and effectively remove moisture to minimize the problems discussed above.

This object is achieved in an apparatus for drying receiver sheets prior to such receiver sheets receiving electrophotographic images, comprising:

at least one set of preconditioning rotatable rollers with each preconditioning rotatable roller in the set touching an opposing preconditioning rotatable roller to form a nip, wherein at least one of the preconditioning rotatable rollers in the set is formed from zirconia ceramic or zirconia composite; and means for heating at least one of the surfaces of the preconditioning rollers of the set to dry receiver sheets as each passes through the nip.

Ceramic rollers used as preconditioning rotatable rollers in accordance with the present invention have increased hardness, toughness and are chemically resistant to corrosion. When used with preprinted receiver sheets in electrophotographic apparatus, toner offset and cleanability are improved and jamming of receiver sheets is reduced. Preconditioning rotatable roller life is improved because of the high wear and abrasion resistant properties of zirconia and its composites.

The unusually high wear abrasion and corrosion resistance of these materials make them particularly suitable for roller material in an electrophotographic apparatus. In the charging section of electrophotographic copiers, ozone may be generated which is a highly corrosive gas. Materials in accordance with the present invention are resistant to attack by ozone.

DETAILED DESCRIPTION OF THE PREFERRED EMBODIMENTS

Figure 1:
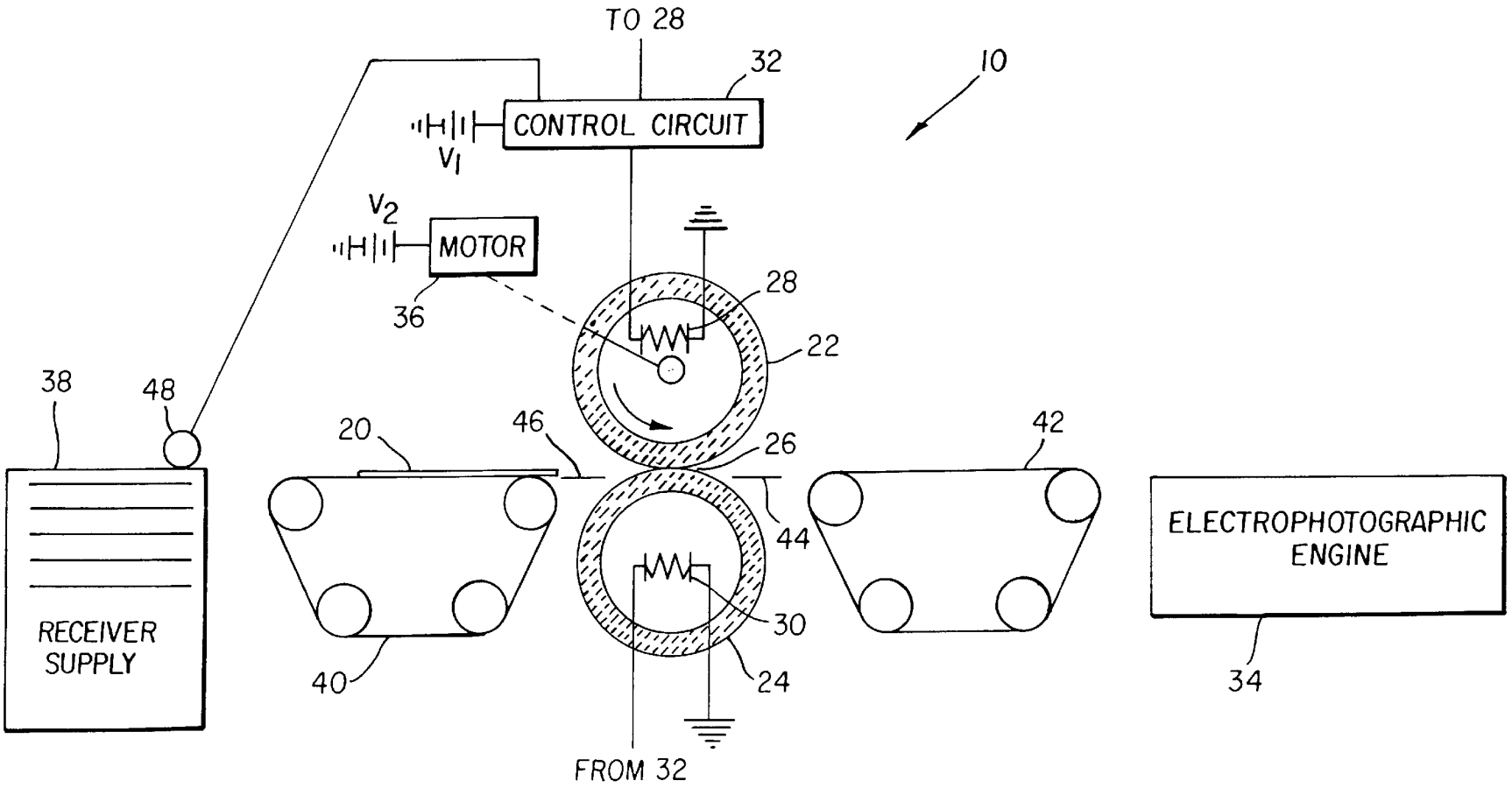
FIG. 1 is a schematic front cross-sectional view of an apparatus which preconditions receiver sheets in accordance with the present invention.

Referring now to FIG. 1 a preconditioning apparatus 10 is shown which includes two preconditioning rotatable rollers (upper) 22 and (lower) 24 which engage to form a nip 26. The nip 26 can be quite narrow since a large nipwidth is not needed as will be explained later. Both preconditioning rotatable rollers 22 and 24 can be made of a very hard zirconia ceramic material. More specifically, the preconditioning rotatable rollers 22 and/or 24 can be made of zirconia ceramic or its composites as will be discussed later. Receiver sheets are transported from the receiver supply 38 to the nip 26 by a roller 48 which feeds sheets to a transport device 40 under the control of control circuit 32. Transport device 40 can be quite conventional since the transport of receivers used in electrophotographic apparatus is well understood in the art. Moisture within a receiver sheet 20 is reduced in amount at the nip 26 by the application of heat and slight pressure. As shown heating lamps 28 and 30 are connected to a control circuit 32 which is connected to a source of power $V_1$. Control circuit 32 can be quite conventional since the heating of radiant lamps within fusing rollers used in electrophotographic apparatus is well understood in the art. A receiver 20 is directed into the nip 26 by a receiver guide 46. Similarly, the receiver 20 is guided out of the nip by a guide 44. Receiver guides 44 and 46 can be quite conventional since the guidance of receivers used in electrophotographic apparatus is well understood in the art. The receiver 20 is transported through the nip 26 with the aid of a motor 36 which drives the preconditioning rotatable roller 22. Alternatively the preconditioning rotatable roller 24 could have been driven or both preconditioning rotatable rollers 22 and 24 could have been driven by separate motors.

Although a single set of preconditioning rotatable rollers 22 an 24 has been shown, in many instances it would be practical to have a plurality of sets of preconditioning rotatable rollers 22 and 24. It is desirable to increase the moisture removing capability by increasing the number of sets of preconditioning rotatable rollers 22 and 24 rather than increasing the nip as to avoid paper distortion. A transport device 42 causes the receiver sheet 20 to be delivered to an electrophotographic apparatus 34 after exiting the preconditioning apparatus 10 to form toner images on a receiver sheet 20. Such electrophotographic apparatus 34 is well known in the art as is the transport device 42 and it is not necessary to describe them here.

In accordance with the present invention, at least one of the preconditioning rotatable rollers 22 and 24 can be made of zirconia ceramic or its composites. However, if both of the preconditioning rotatable rollers 22 and 24 are to be made of a zirconia ceramic material, then it may be preferable to have one of the preconditioning rotatable rollers 22 and 24 made of a zirconia ceramic composite. In this situation, no appreciable nipwidth is needed and thus the material would not be worn more rapidly by itself. In accordance with the present invention, there are several possibilities, which include either having one or more sets of preconditioning rotatable rollers 22 and 24. It will be understood that one of the preconditioning rotatable rollers 22 and 24 in a set must be made from zirconia or zirconia ceramic and its composites. The other preconditioning rotatable roller can be preferably made from a compliant material such as a thermally stable elastomer or foam or a noncompliant material such as anodized aluminum. When a preconditioning rotatable roller surface is made of or zirconia composite more thermal conductivity than zirconia and so it is used to provide preconditioning rotatable rollers 22 and 24 which transfer heat. On the other hand, zirconia is a poor heat conductor and so after it is heated it will maintain a given temperature for a longer time.

Zirconia has the chemical composition of $ZrO_2$ and with a predominately tetragonal crystal structure. The composites of zirconia can take many forms, however, in accordance with this invention that tenn shall mean alumina composites ($ZrO_2$—$Al_2O_3$), which will be discussed in more detail later. These materials, because of its specific crystallographic nature, which will be described later, have high hardness, and unusually high fracture toughness for ceramics. The zirconia ceramic and its composites materials have a hardness greater than 12 GPa and toughness greater than 6 MPa $\sqrt{mm}$. Sometimes it is desirable to heat the preconditioning rotatable rollers 22 and 24 and in such a case, the preconditioning rotatable rollers 22 and 24 can be formed with a cavity and heated lamps 28 and 30 which are shown inside of either or both of the preconditioning rotatable rollers 22 and 24. The heated lamps 28 and 30 are controlled by the control circuit 32 in a manner well understood in the art.

Zirconia ceramic, particularly yttria doped tetragonal zirconia polycrystals (Y-TZP) and its composites such as $ZrO_2$—$Al_2O_3$ are known to posses high wear and abrasion resistance. Tetragonal zirconia also has high hardness and high fracture in toughness. It is also known that surface energy of the zirconia ceramics and its composites can be modified by changing the oxidation states of the materials. It is further known that infrared energy can be successfully utilized to modify both the surface morphology and surface energy of zirconia ceramics and its composites.

Pure zirconia powder is alloyed with stabilizing agents as described by Chatterjee et al in commonly-assigned U.S. Pat. No. 5,358,913 to form zirconia alloy powder which has predominately tetragonal crystal structure. One such example of such powder is yttria stabilized tetragonal zirconia polycrystals (Y-TZP). Y-TZP can also be mixed with other ceramic powders to form composites. One example of such composites is zirconia-alumina composites, where alumina concentration can vary from 0.1 to 50 weight percent. It has been found preferable to use a weight percentage of alumina of about 20 percent.

The powders described above form the starting materials for the formation and manufacture of preconditioning rotatable rollers 22 and 24 for use in the preconditioning apparatus 10. The preconditioning rotatable rollers 22 and 24 can be manufactured either by cold pressing or cold isostatic pressing or by injection molding and sintering. The various procedures for manufacturing preconditioning rotatable rollers 22 and 24 using ceramic materials, particularly for Y-TZP and its composites are disclosed by Ghosh et al in commonly-assigned U.S. Pat. No. 5,336,282 and Chatterjee et al in commonly-assigned U.S. patent application Ser. No. 8/740,452 filed Oct. 28, 1996.

Ytrria-doped tetragonal zirconia polycrystal (Y-TZP) ceramic materials offer many advantages over conventional materials, including many other ceramics. Y-TZP is one of the toughest ceramics. The toughness is achieved at the expense of hardness and strength. Tetragonal zirconia alloy-alumina composite, that is, the product of sintering a particulate mixture of zirconia alloy and alumina, is another tough and relatively softer structural ceramic composite.

The zirconium oxide alloy is made essentially of zirconium oxide and a secondary oxide selected from the group consisting of MgO, CaO, $Y_2O_3$, $Sc_2O_3$, $Ce_2O_3$ and rare earth oxides. Moreover, the zirconium oxide alloy has a concentration of the secondary oxide of, in the case of $Y_2O_3$, about 0.5 to about 5 mole percent; in the case of MgO, about 0.1 to about 1.0 mole percent, in the case of $CeO_2$, about 0.5 to about 15 mole percent, in the case of $Sc_2O_3$, about 0.5 to about 7.0 mole percent and in the case of CaO from about 0.5 to about 5 mole percent, relative to the total of the zirconium oxide alloy. A mold is provided for receiving and processing the zirconia alloy ceramic powder or its composites. The ceramic powder is then compacted by cold isostatic pressing in the mold provided to form a ceramic blank or billet. The ceramic billet is then shaped or green-machined so as to form near net-shaped preconditioning rotatable rollers 22 and 24. The term "green" refers to the preconditioning rotatable rollers 22 and 24 before sintering. After the initial shaping, the green rollers are sintered thereby forming sintered net-shaped ceramic rollers. The preconditioning rotatable rollers 22 and 24 for the preconditioning apparatus 10 described above, are then further machined or shaped until finished preconditioning rotatable rollers 22 and 24 are formed.

The preferred ceramic composite powder mixture most preferred in the method of making zirconia-alumina ceramic composites of the invention includes a particulate zirconia alloy and a particulate alumina made by mixing $ZrO_2$ and additional "secondary oxide" selected from: MgO, CaO, $Y_2O_3$, $Sc_2O_3$ and $Ce_2O_3$ and other rare earth oxides (also referred to herein as "Mg—Ca—Y—Sc—rare earth oxides") and then with $Al_2O_3$. Zirconia alloys useful in the methods of the invention have a metastable tetragonal crystal structure in the temperature and pressure ranges at which the ceramic article produced will be used. For example, at temperatures up to about 200° C. and pressures up to about 1000 MPa, zirconia alloys having, wherein zirconium oxide alloy has a concentration of the secondary oxide of, in the case of $Y_2O_3$, about 0.5 to about 5 mole percent; in the case of MgO, about 0.1 to about 1.0 mole percent, in the case of $Ce_2O_3$, about 0.5 to about 15 mole percent, in the case of $Sc_2O_3$, about 0.5 to about 7.0 mole percent and in the case of CaO from about 0.5 to about 5 mole percent, relative to the total of said zirconium oxide alloy, said compacting further comprising forming a blank and then sintering, exhibit a tetragonal structure. Preferred oxides for alloying with zirconia are $Y_2O_3$, MgO, CaO, $Ce_2O_3$ and combinations of these oxides. It is preferred that the zirconia powder have high purity, greater than about 99.9 percent. Specific examples of useful zirconia alloys include: tetragonal structure zirconia alloys having from about 2 to about 5 mole percent $Y_2O_3$, or more preferably about 3 mole percent $Y_2O_3$. Examples of tetragonal structure zirconia alloys are disclosed in commonly-assigned U.S. Pat. No. 5,290,332. Such zirconia alloys are described in that patent as being useful to provide a ceramic roller.

The grain and agglomeration sizes and distributions, moisture contents, and binders (if any) can be varied in both the alumina and the zirconia alloy, in a manner known to those skilled in the art. "Grain" is defined as an individual crystal, which may be within a particle, having a spatial orientation that is distinct from that of adjacent grains. "Agglomerate" is defined as an aggregation of individual particles, each of which may comprise multiple grains. In a particular embodiment of the invention, the grain and agglomeration sizes and distributions, and moisture contents of the alumina and the zirconia alloy are substantially the same and are selected as if the zirconia alloy was not going to be mixed with the alumina, that is in a manner known to the art to be suitable for the preparation of a zirconia alloy article.

An example of convenient particulate characteristics for a particular embodiment of the invention is the following. Purity of $ZrO_2$ is preferably well controlled at 99.9 to 99.99 percent, that is, impurities are no more than about 0.1 to 0.01 percent. The grain size is from about 0.1 micrometers to about 0.6 micrometers. The average grain size is 0.3 micrometers. The distribution of grain sizes is: 5–15 percent less than 0.1 micrometers, 40–60 percent less than 0.3 micrometers, and 85–95 percent less than 0.6 micrometers. The surface area of each individual grain ranges from about 10 to about 15 $m^2$/gram or is preferably 14 $m^2$/gram. Agglomerate size is from about 30 to about 60 micrometers and average agglomerate size is: 40–60 micrometers. Moisture content is about 0.2 to 1.0 percent by volume of blank and is preferably 0.5 percent. The mixture of particulate is compacted in the presence of an organic binder.

Binders such as gelatin or polyethylene glycol(PEG) or acrylic or polyvinyl ionomer or more preferably polyvinyl alcohol, are added to and mixed with the particulate mixture Y-TZP, or a composite mixture of Y-TZP and alumina. This can be achieved preferably by spray drying or ball milling prior to placement of the mixture in a compacting device.

The particulate mixture of zirconia alloy and/or zirconia-alumina ceramic composite is compacted; heated to a temperature range at which sintering will occur; sintered, that is, maintained at that temperature range for a period of time; and then cooled. During sintering, individual particles join with each other and transform from "green preform" to a dense article. This densification is achieved by diffusion controlled process. In an alternate embodiment, during all or part of sintering, the particulate mixture compact or the "green preform" is kept in contact with a preselected dopant, as discussed below in detail, to further improve the surface properties of the sintered articles.

Preferably, the powder mixture is cold compacted to provide a "green preform", which has a "green" density that is substantially less than the final sintered density of the preconditioning rotatable rollers 22 and 24 of the preconditioning apparatus 10. It is preferred that the green density be between about 40 and about 65 percent of the final sintered density, or more preferably be about 60 percent of the final sintered density.

Then the green rollers are sintered to full density using preferably sintering schedules described in U.S. Pat. Nos. 5,336,282 and 5,358,913, hereby incorporated hereby by reference, and final precision machining of the final sintered rollers were made to tight tolerances to produce the rollers of electrophotographic apparatus of the invention using diamond tools. Near net-shaped green preforms produced either by dry pressing or by injection molding, respectively, did not warrant green machining to generate net-shaped rollers after sintering. Only billets or blanks of zirconia ceramic or its composites produced by cold isostatic pressing needed green machining before sintering. The near-net-shaped green preform produced by injection molding needed an additional step called "debinding" wherein excess organic binders are removed by heating the preforms at around 250° C. for about 12 hours prior to sintering.

In an alternate embodiment of the sintering process, the dopant oxide selected from MgO, FeO, ZnO, CoO, NiO, and MnO, and combination thereof, is in contact with the blank. It is preferred that the sintering result in a zirconia ceramic and/or zirconia ceramic composite preconditioning rotatable rollers 22 and 24 having a "full" or nearly theoretical density, and it is more preferred that the density of the preconditioning rotatable rollers 22 and 24 be from about 99.5 to about 99.9 percent of theoretical density. Sintering is conducted in air or other oxygen containing atmosphere.

Sintering can be performed at atmospheric pressure or alternatively a higher pressure, such as that used in hot isostatic pressing can be used during all or part of the sintering to reduce porosity. The sintering is continued for a sufficient time period for the case of the article being sintered to reach a thermodynamic equilibrium structure. An example of a useful range of elevated sintering pressures is from about 69 MPa to about 207 MPa, or more preferably about 100 to 103 MPa.

The toners used in the working and comparative examples of this invention are 100 percent unfused EK1580 toner (Eastman Kodak Company, Rochester, N.Y.). The off-line testing of the preconditioning roller material is carried out both in the "dry" condition and also in the "wet" condition, where the preconditioning roller materials, in the form of a plate are treated with offset preventing oils. The experimental set-up for the off-line test, wherein a heated bed on which the preconditioning roller materials of interest were placed. An inch square piece of paper with 100% unfused toner laydown was then placed in intimate contact with the preconditioning roller materials in the specific case, Y-TZP and its composites with alumina. To ensure the intimate contact a clamp was used. The bed of the tester is heated to predetermined fusing temperatures and a thermocouple (not shown) registers this temperature. Two temperatures, 165° C. and 190° C. were used. A pressure application device set for 80 pounds per square inch was then locked in place over the preconditioning roller material/toner/receiver sheet sandwich. The pressure was applied for such off-line testing from a minimum of 30 seconds to a maximum, in most cases of 20 minutes. The release characteristics were evaluated by visual inspection of the fused receiver sheets.

The preconditioning rotatable rollers 22 and 24 of this invention were irradiated with infrared energy specifically with a Nd-YAG laser of 1.06 $\mu$m wavelength operated at various conditions. Laser assisted irradiation of these materials causes a surface chemical composition change of the ceramic materials used in this invention. As disclosed by Chatterjee et al in commonly-assigned U.S. Pat. No. 5,543,269 laser induced surface, that the chemical composition change is associated with surface energy change and it is believed in the specific case of the present invention that reactivity of the particulate imaging material with the preconditioning roller material are modified through the change in its surface energy. However, laser irradiation of materials can be a source of degradation of surface morphology. The rough surface morphology can cause toner offset. Hence, laser irradiation parameters have to be selected judiciously to take advantage of the surface energy reduction.

It should be noted that the zirconia or zirconia ceramic or its composite rollers were treated a single time with an appropriate offset preventing oil. It is not necessary to continuously apply an appropriate offset preventing oil to these rollers. Quite unexpectedly it has been found that certain offset preventing oils react with zirconia ceramic or its composites to prevent offset. In accordance with the present invention, it has been found to be highly desirable to first react the surface of the preconditioning rotatable rollers 22 and 24 with these offset preventing oils. The following is a discussion of the different offset preventing oils which can be used with treated and untreated preconditioning rotatable rollers 22 and 24 which have their surfaces formed of zircon ceramic or its composites.

The following summary shows the types of offset preventing oil that will be effective with treated and untreated zirconia and treated and untreated zirconia composites.

| Preconditioning Roller | Zirconia ($ZrO_2$) | Zirconia Composites ($ZrO_2$—$Al_2O_3$) |
|---|---|---|
| Two Material Processing for Each Material | 1) Untreated<br>2) Treated with IR Laser | 1) Untreated<br>2) Treated with IR Laser |
| Three Oils (for untreated materials) for release | 1) Non functional<br>$CH_3-Si(CH_3)_2-O$ | 1) Non-functional<br>$CH_3-Si(CH_3)_2-O$ |
| | 2) Silane<br>H—Si—<br>3) Amino<br>$H_2N—CH_2CH_2CH_2—$ | 2) Silane<br>H—Si—<br>3) Amino<br>$H_2N—CH_2CH_2CH_2—$ |
| Two Oils (for IR Laser Treated Materials) for release | 1) Silane<br>H—Si—<br>2) Amino<br>$H_2N—CH_2CH_2CH_2—$ | 1) Silane<br>H—Si—<br>2) Amino<br>$H_2N—CH_2CH_2CH_2—$ |

TABLE I

Laser Irradiation Conditions

Nd:YAG Laser:Wavelength=1.06 $\mu$m
Pulse Frequency=1 KHz
Bite Size=0.05209 mm
Peak Power=6,000–67,000 Watts
Current=18–28 amps
Energy=0.6 mJ to 5.2 mJ
Energy Density=7 J/cm$^2$ to 66 J/cm$^2$ The following is a discussion of offset preventing oils that can be used with any of the untreated preconditioning rotatable rollers 22 and 24 and with a treated (irradiated) preconditioning rotatable rollers 22 and 24 that can be used in accordance with this invention. It has been found that in either case offset preventing oils that are effective have compounds having functional groups selected from the group including $—CH_2—CH_2—CH_2—NH_2$ and

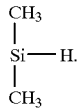

When untreated preconditioning rotatable rollers 22 and 24 are used, the offset preventing oil has functional groups selected from the groups consisting of $—CH_2—CH_2—CH_2—NH_2$,

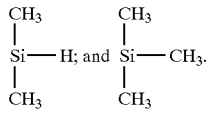

When treated preconditioning rotatable rollers 22 and 24 are used the offset preventing oil has functional groups selected from the groups consisting of $—CH_2—CH_2—CH_2—NH_2$ and

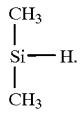

Another aspect of the change in the reactivity of the toner particles with some functional offset preventing oils. As described hereinafter that the reactivity of toner particles with the preconditioning roller materials is hindered by formation of some sort of barriers caused by the absorption of offset preventing oils into the pores of the preconditioning roller materials. The Theological property, such as viscosity and the chemical property, such as molecular weight of the offset preventing oils will greatly influence the barrier formation between the toner particles and the preconditioning roller materials.

Chemical structure of functional polydimethyl siloxane and non-functional polydimethyl siloxane (PDMS) which will be discussed as follows:

1. Non-functional PDMS

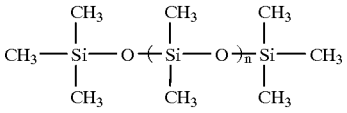

wherein n: $50 \leqq n \leqq 1000$

2. Mercapto functional PDMS

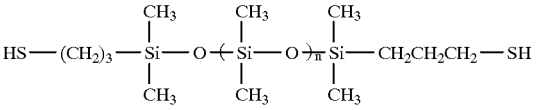

wherein:

n: $50 \leqq n \leqq 1000$

3. Silane functional PDMS

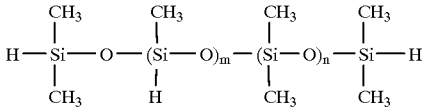

wherein m,n: $1\% \leqq m \leqq 99\%$ $1\% \leqq n \leqq 99\%$ $m+n=100\%$

4. Amino functional PDMS

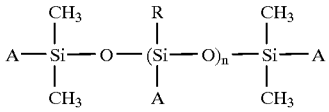

wherein

A: is $—CH_2—CH_2—CH_2—NH_2$ n: $50 \leqq n \leqq 1000$

R: is an alkyl or aryl group

Examples (for laser irradiated zirconia ceramic or its composites preconditioning rotatable rollers):

The affinity of the functional offset preventing oil of this invention to laser treated preconditioning roller surface in the process of the present invention can be assessed from the results of applying functional polydimethyl siloxane release offset preventing oil to a preconditioning roller surface (Heated Roll) comprising, for example, a 18 amp zirconia ceramic or its composites samples laser treated using 18 amps incubating the samples overnight (12 hrs) at 170° C. in contact with the functional PDMS, then subjecting the ceramic surface to soak in DCM (dichloromethane) for one hour, removed and wiped to clean unreacted functional offset preventing oil. Qualitative measurements of the attachment of the polydimethyl siloxane to the surface of the laser treated ceramic were carried out by the offline toner contamination unit. The offline test for toner contamination is a heated bed on which the ceramic samples are placed. A 1" square piece of paper with 100% unfused EK1580 toner is put in contac with the ceramic samples which are cut into a 1" squares. The sandwich is then heat temperature of 175° C. A pressure roller set for 80 psi is then locked in place over the sample for 20 minutes. The test forms a nip under pressure and the interaction between the toned paper and the ceramic sample in the nip area is examined using an optical microscope. The toner release performance of the ceramic sample is assessed by the amount of toner (offset) on the surface of the ceramic sample.

Three major types of functional offset preventing oil (silane functional offset preventing oil, amino functional offset preventing oil, and mercapto functional offset preventing oil) were used in the test. In addition, the non-functional offset preventing oil and no offset preventing oil also were used as controls.

Specific examples of commercially available functionalized polydimethylsiloxanes of utility in this invention include:

1) organohydrosiloxane copolymers such as
   (a) PS 123, (30–35%) methylhydro—(65–70%) dimethylsiloxane
   (b) PS 124.5, (3–4%) methylhydro—(96–99%) dimethylsiloxane which are available from United Chemical, Inc.
2) aminopropyldimethyl tenninated polydimethylsiloxane Xerox 5090 fuser agent which is available from Xerox
3) mercapto functional polydimethylsiloxane Xerox 5090 fuser agent which is available from Xerox
4) non-functional polydimethylsiloxane, trimethylsiloxane terminated DC-200, 350 Cts which is available from Dow Corning Table II below shows the results obtained from the examples.

TABLE II

| Zirconia Ceramic and its Composite Materials* | Siloxane | Organopoly-Group | Functional Offset | Oil Reactivity |
|---|---|---|---|---|
| 18 amp | None | None | Heavy | No |
| 18 amp | DC-200, 350 Cts | trimethyl-siloxane | Heavy | No |
| 18 amp | Xerox 5090 fuser agent | mercapto- propyl | Heavy | No |
| 18 amp | PS-123 | hydro- silane | None | Yes |
| 18 amp | PS-124.5 | hydro- silane | None | Yes |
| 18 amp | Xerox 5090 fuser agent | amino- propyl | Slight | Yes |
| 24 amp | PS-124.5 | hydro- silane | Heavy | No |
| 24 amp | Xerox 5090 fuser agent | amino- propyl | Heavy | No |
| 24 amp | Xerox 5090 fuser agent | mercapto- propyl | Heavy | No |

*Laser treated using conditions described in Table I.

For a surface reacted and covered with functional polydimethylsiloxane, the toner offset should be zero or close to zero (slight offset). Referring to Table II, the non-functionalized polydimethylsiloxane DC-200 or no offset preventing oil used provide no offset preventing oil coverage on the ceramic samples. Use of the Si-H functionalized polydimethylsiloxane PS-123, and PS-124.5 provide superior toner release properties. Use of the aminopropylsiloxane functionalized polydimethylsiloxane Xerox 5090 fuser agent also provides the offset preventing oil coverage, but this functional offset preventing oil suffers slight offset. Thus, results as good or better than those with the non-functionalized polydimethylsiloxane or no polydimethylsiloxane can be obtained by use of a functional polydimethylsiloxane comprising a Si-H functionalized PDMS or aminopropyl functionalized PDMS with the zirconia ceramic and its composites laser treated following the conditions described in Table I in accordance with the invention.

Referring to Table II, the use of a zirconia ceramic and its composites laser treated using 24 amps following the conditions described in Table I with the functionalized PDMS (see C-4, C-5, C-6) did not provide any offset preventing oil coverage on the ceramic samples. The laser operating conditions for treatment of zirconia ceramic and its composite samples are important.

The high affinity of Si-H functionalized and aminopropyl functionalized organopolysiloxane with the 18 amp ceramic compound for preconditioning roller surface provides excellent release of preprinted fused toner image. Use of this surface as preconditioning roller in a preconditioning apparatus provides a highly effective way of meeting the need for excellent release characteristics without excessive wear of the preconditioning roller surface.

Examples (untreated zirconia ceramic or composite preconditioning rotatable rollers)

The affinity of functional offset preventing oil of this invention to untreated (non-laser irradiated) preconditioning roller surface in the process of this invention can be assessed from the results of apply functional polydimethylsiloxane release offset preventing oil. The samples were treated and tested similar to the previous examples.

Referring to Table III below, the mercapto functionalized PDMS and no offset preventing oil provide no protection on the surface of the ceramic sample. Use of Si-H functionalized PDMS PS-123, PS-124.5, aminopropyl functionalized PDMS and non-functionalized PDMS provide superior toner release property on the untreated $ZrO_2$ ceramic materials. Use of this surface in a preconditioning apparatus provides a highly effective way of meeting the need for excellent release characteristics without excessive wear of the preconditioning roller and without encountering the problems of odor and toxicity associated with use of mercapto-functional polydimethylsiloxanes.

Table III below shows the results obtained from the examples of untreated zirconia ceramic or its composites.

TABLE III

| Zirconia Ceramic and its Composite Materials | Organopoly-siloxane | Toner Offset | Oil Reactivity |
|---|---|---|---|
| untreated | None | Heavy | No |
| untreated | Xerox 5090 fuser agent | Heavy | No |
| untreated | Mercapto-functionalize PS-123 Si—H functionalized | None | Yes |
| untreated | PS-124.5 Si—H functionalized | Slight | Yes |
| untreated | Xerox 5090 Amino-function fuser agent | Slight | Yes |
| untreated | DC-200 | Slight | Yes |

The invention has been described in detail with particular reference to certain preferred embodiments thereof, but it will be understood that variations and modifications can be effected within the spirit and scope of the invention.

PARTS LIST

10 preconditioning apparatus
20 receiver
22 preconditioning rotatable roller
24 preconditioning rotatable roller
26 nip
28 heater lamp
30 heater lamp
32 control circuit
34 electrophotographic engine
36 motor
38 receiver supply
40 receiver transport device
42 receiver transport device
44 receiver guide
46 receiver guide
48 roller

What is claimed is:

1. Apparatus for drying receiver sheets prior to such receiver sheets receiving electrophotographic images, comprising:

at least one set of preconditioning rotatable rollers with each preconditioning rotatable roller in the set touching an opposing preconditioning rotatable roller to form a nip, wherein at least one of the preconditioning rotatable rollers in the set is formed from zirconia ceramic or zirconia composite and is treated with an offset preventing oil; and means for heating at least one of the surfaces of the preconditioning rollers of the set to dry receiver sheets as each passes through the nip.

2. The apparatus of claim 1 wherein the offset preventing oil includes compounds having functional groups selected from the groups consisting of —$CH_2$—$CH_2$—$CH_2$—$NH_2$,

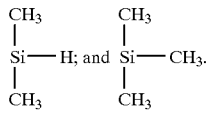

3. The apparatus of claim 1 wherein the offset preventing oil has been treated with IR laser light to change the surface energy of the zirconia ceramic or zirconia composite includes compounds having functional groups selected from the groups consisting of —$CH_2$—$CH_2$—$CH_2$—$NH_2$ and

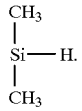

4. The apparatus of claim 1 wherein the offset preventing oil is selected from the group consisting of:

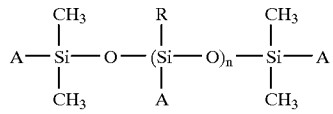

A: is —$CH_2$—$CH_2$—$CH_2$—$NH_2$ n: $50 \leqq n \leqq 1000$

R is an alkyl or aryl group

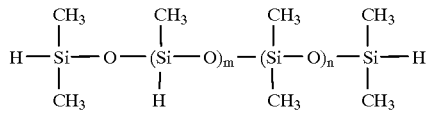

wherein m,n: 1%≦m≦99%

1%≦n≦99% m+n=100%; and

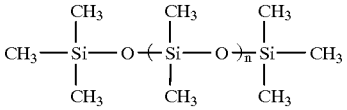

where n: 50≦n≦1000.

5. The apparatus of claim 1 wherein the offset preventing oil includes compounds having functional groups selected from the groups consisting of:

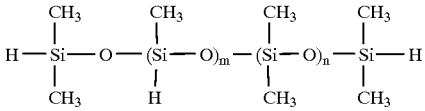

wherein m,n: 1%≦m≦99%

1%≦n≦99% m+n=100%; and

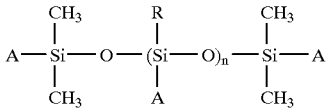

A is —$CH_2$—$CH_2$—$CH_2$—$NH_2$ n: 50≦n≦1000

R is an alkyl or aryl group.

6. Apparatus for drying receiver sheets prior to such receiver sheets receiving electrophotographic images, comprising:

at least one set of preconditioning rotatable rollers with each preconditioning rotatable roller in the set touching an opposing preconditioning rotatable roller to form a nip, wherein each of the preconditioning rotatable rollers in the set is formed from zirconia ceramic or zirconia composite;

means for heating at least one of the surfaces of the preconditioning rotatable rollers of the set to dry receiver sheets as each passes through the nip; and the surface of each of the preconditioning rotatable rollers being treated with an offset preventing oil.

7. The apparatus of claim 6 wherein the offset preventing oil includes compounds having functional groups selected from the groups consisting of —$CH_2$—$CH_2$—$CH_2$—$NH_2$,

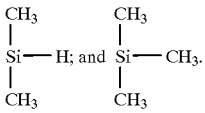

8. The apparatus of claim 6 wherein the offset preventing oil has been treated with IR laser light to change the surface energy of the zirconia ceramic or zirconia composite includes compounds having functional groups selected from the groups consisting of —$CH_2$—$CH_2$—$CH_2$—$NH_2$ and

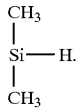

9. The apparatus of claim 6 wherein the offset preventing oil is selected from the group consisting of:

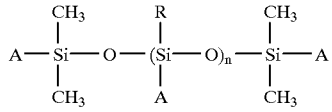

A: is —$CH_2$—$CH_2$—$CH_2$—$NH_2$ n: 50≦n≦1000

R is an alkyl or aryl group

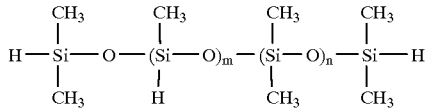

wherein m,n: 1%≦m≦99%

1%≦n≦99% m+n=100%; and

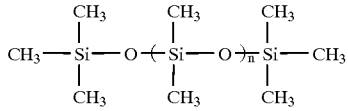

where n: 50≦n≦1000.

10. The apparatus of claim 6 wherein the offset preventing oil includes compounds having functional groups selected from the groups consisting of:

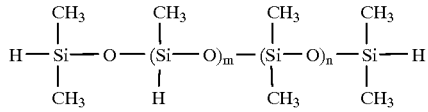

wherein m,n: 1%≦m≦99%

1%≦n≦99% m+n=100%; and

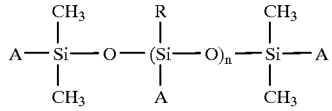

A is —$CH_2$—$CH_2$—$CH_2$—$NH_2$ n: 50≦n≦1000

R is an alkyl or aryl group.

* * * * *